United States Patent [19]

Kester et al.

[11] 4,356,643

[45] Nov. 2, 1982

[54] NON-SLIP FOOTWEAR

[76] Inventors: Adelbert L. Kester; George Spector, both of 3615 Woolworth Bldg., 233 Broadway, New York, N.Y. 10007

[21] Appl. No.: 211,079

[22] Filed: Nov. 28, 1980

[51] Int. Cl.[3] ..... A43B 23/28

[52] U.S. Cl. ..... 36/59 C

[58] Field of Search ..... 36/7.6, 7.7, 25 R, 59 R, 36/59 B, 59 C, 59 D; 2/239; 15/227; 152/212

[56] References Cited

U.S. PATENT DOCUMENTS

| | | | |
|---|---|---|---|
| 2,400,487 | 5/1946 | Clark | 36/59 C X |
| 3,084,732 | 4/1963 | Kronstein | 152/212 |
| 3,460,182 | 8/1969 | Grande | 15/227 |
| 3,555,697 | 1/1971 | Dassler | 36/59 C X |
| 3,863,272 | 2/1975 | Guille | 2/239 |
| 3,888,026 | 6/1975 | Dassler | 36/25 R |
| 4,007,549 | 2/1977 | Moore | 36/59 C |

*Primary Examiner*—Richard J. Scanlan, Jr.

[57] ABSTRACT

A footwear having an underside of the sole thereof covered by a friction pad comprised of interlaced or intertwisted, relatively stiff nylon fibers woven through a backing liner secured to the sole underside, while the lower, outer surface of the pad thus formed, serves to engage a slippery surface without possible slipping.

1 Claim, 5 Drawing Figures

Fig. 1
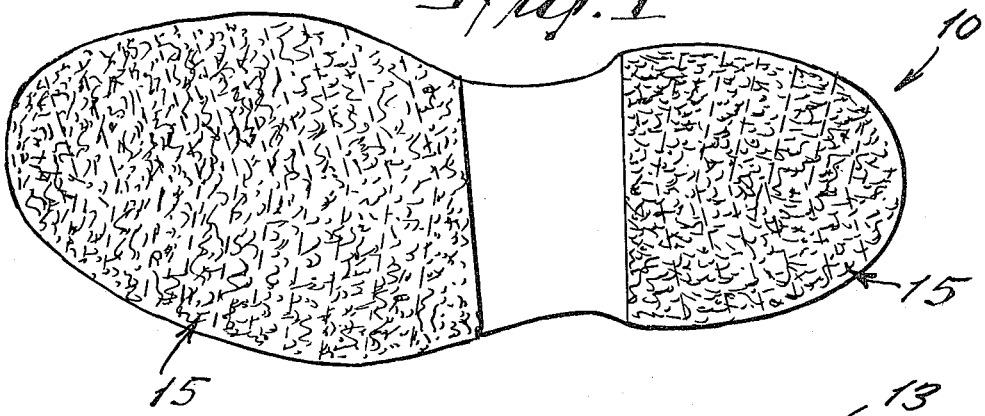
Fig. 2
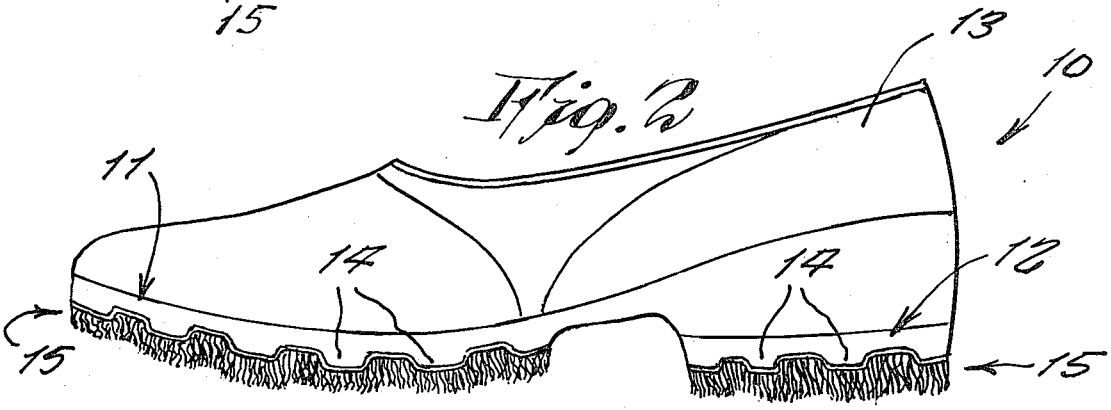
Fig. 3
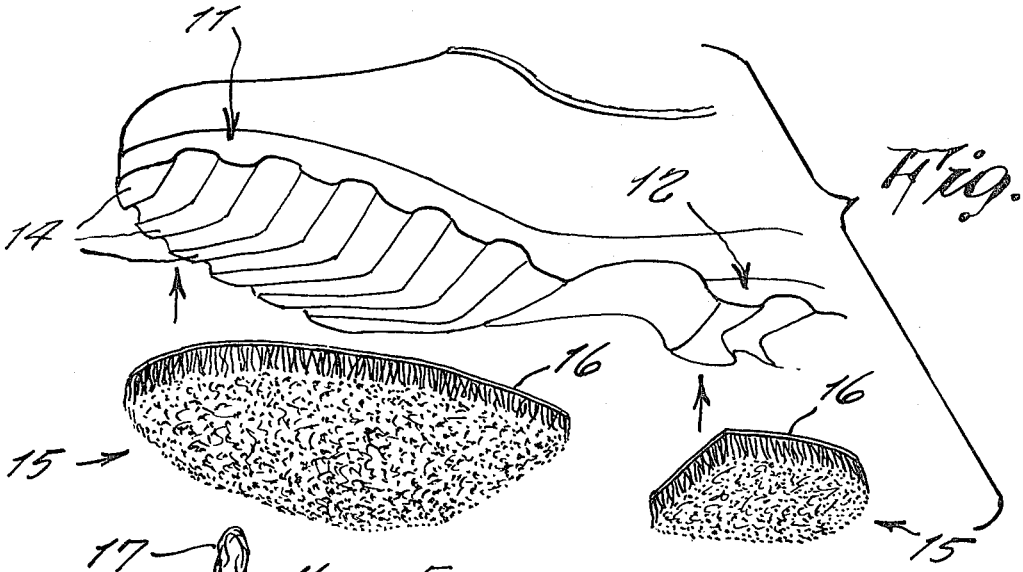
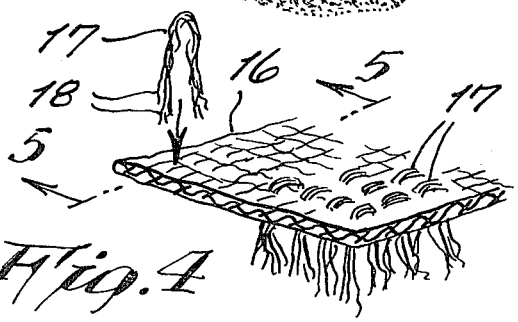
Fig. 4
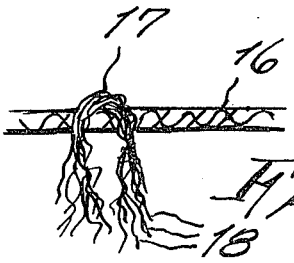
Fig. 5

NON-SLIP FOOTWEAR

This invention relates generally to footwear having non-skidding features.

It is well known that a person slipping on a skiddy surface such as is covered by ice, water oil or grease, is subject to easily become injured by a fall thereupon, and numerous improvements have been developed for footwear in the past, for a solution against slipping. However none apparently have proved to be ideal, in view that none have been adopted, and the problem still remains, without a practical solution heretofore.

Accordingly it is a principal object of the present invention, to provide a non-slip footwear the underside of which is covered with a friction pad having the friction characteristics of a conventional abrasive pads such as is used to scour burned pots and pans, and which are presently being marketed under the tradename of Scotch-Brite listed in catalogue No. 86 of 3M Company of St. Paul, Minn.

Another object is to provide a non-slip footwear wherein a friction pad of the above character is rigidly secured to the footwear so that it does not readily wear out quickly.

Still another object is to provide a non-slip footwear which additionally includes a cleated sole to which the friction pad is secured for additional protection from skidding.

FIG. 1 is a bottom view of one design of the invention in which the non-slip pad is adhered to a cleated shoe sole so that the pad additionally is thus treated for additional frictional grasp of a walking surface.

FIG. 2 is a side view thereof.

FIG. 3 is a fragmentary perspective view of the pads positioned for mounting on the shoe sole.

FIG. 4 is an enlarged detail perspective view of the pad showing that the Scotch-Brite like filaments are stitched through a backing liner so as to present them from readily falling out.

FIG. 5 is a farther enlarged cross sectional view through of FIG. 4.

Referring now to the drawing in greater detail, the reference numeral 10 represents a non-slip footwear according to the present invention, wherein the same includes a sole 11 and a heel 12 secured to a bottom of a footwear upper 13. The sole and the heel may be made of any conventional materials used for such footwear components. However in one design of the present invention, the underside surface thereof may be contoured with downward cleats 14 as shown, the cleats being V-shaped with those of the sole being apexed rearwardly and those of the heel being apexed forwardly are shown in FIG. 1.

In the present invention, a friction pad 15 is permanently affixed to the underside of the sole and heel. The pad includes a woven backing liner 16 that may be made from a strong, tough duck through which strands 17 of individual nylon fibers 18 are woven; the fibers being of stiff wiry character that are intertwisted or intermatted together with the ends of the fibers protruding outwardly in a tight, tangled mass so to be resistant against individually being worn down when abrased against a pavement or other walking surface.

The backing liner through which the strands are looped in a U-shape, is securely adhered to the underside of the sole and heel by means of suitable strong adhesives.

As shown in FIG. 2, due to the contoured cleats, the lower surface of the friction pad may be correspondingly somewhat contoured when the footwear is new and unworn. In time with normal wear and use, the lower extending fibers will wear down so that the pad underside contour becomes level throughout. This will not in any way detract from the merits of the invention due to the thinner portions of the pad located directly under the cleats thus becoming relatively more stiff than the other pad portions, due to the shorter fibers flexing less. Thus the effect will still remain that of a cleated contour.

In operative use, the tight matted ends of the fibers produce a non-slip surface for walking upon either icy, wet, oil or greasy surfaces.

What is claimed as new, is:

1. A non-slip footwear, comprising in combination a shoe or the like including an upper, a sole and a heel at a bottom thereof, and a matted friction pad affixed under said sole and heel said pad being made of U-shaped strands of nylon stiff fibers woven through a backing liner affixed to said sole and heel and lower ends of said fibers, extending downward wherein an underside of said sole and heel to which said friction pad is affixed, are contoured with cleats said pad being similary contoured when mounted on said sole and heel presenting a contoured fiber surface for contact with a walking surface and wherein said pad fits between said cleats to interlock therewith.

* * * * *